US011780058B1

(12) United States Patent
Lin

(10) Patent No.: US 11,780,058 B1
(45) Date of Patent: Oct. 10, 2023

(54) TERMINAL CRIMP TOOL CAPABLE OF REPLACING JAWS BY RAPID INSERTION AND EXTRACTION

(71) Applicant: Yueqing Fosite Tools Co., Ltd., Wenzhou (CN)

(72) Inventor: Ye Lin, Wenzhou (CN)

(73) Assignee: Yueqing Fosite Tools Co., Ltd., Yueqing (CN)

( * ) Notice: Subject to any disclaimer, the term of this patent is extended or adjusted under 35 U.S.C. 154(b) by 67 days.

(21) Appl. No.: 17/820,254

(22) Filed: Aug. 17, 2022

(30) Foreign Application Priority Data

Jul. 25, 2022 (CN) ..... 202221951411.5

(51) Int. Cl.
*B25B 7/04* (2006.01)
*H01R 43/042* (2006.01)

(52) U.S. Cl.
CPC ..... *B25B 7/04* (2013.01); *H01R 43/042* (2013.01)

(58) Field of Classification Search
CPC ..... B25B 27/146; B25B 7/02; B25B 7/04; H01R 43/0427; H01R 43/0428; H01R 43/042; Y10T 29/53226
USPC ..... 72/409.01, 409.16, 409.19, 414; 140/105, 106
See application file for complete search history.

(56) References Cited

U.S. PATENT DOCUMENTS

| | | | | |
|---|---|---|---|---|
| 5,012,666 | A * | 5/1991 | Chen | H01R 43/042 81/382 |
| 9,782,283 | B2 | 10/2017 | Abbate et al. | |
| 11,191,540 | B2 | 12/2021 | Aronhalt et al. | |
| 11,241,230 | B2 | 2/2022 | Shelton, IV et al. | |
| 2007/0283740 | A1* | 12/2007 | Li | B25B 27/146 72/409.16 |
| 2009/0308132 | A1* | 12/2009 | Lai | H01R 43/042 81/355 |
| 2015/0162716 | A1* | 6/2015 | Lai | H01R 43/042 72/409.14 |
| 2015/0372435 | A1* | 12/2015 | Li | H01R 43/042 29/751 |

* cited by examiner

*Primary Examiner* — Bobby Yeonjin Kim
(74) *Attorney, Agent, or Firm* — True Shepherd LLC; Andrew C. Cheng

(57) ABSTRACT

A terminal crimp tool capable of replacing jaws by rapid insertion and extraction includes a crimp tool body. A pair of openable heads are provided at a front end of the crimp tool body, and the two heads each are provided with a jaw. Two clamping plates are provided at a front part of each of the heads, a jaw mounting groove is formed between the two clamping plates, and a positioning member is provided in the jaw mounting groove. The jaw is mounted in the jaw mounting groove, positioning protrusions extending along a front-rear direction and respectively abutting against inner side edges of the two clamping plates are provided on two sides of the jaw, a clamping notch is provided on a rear part of the jaw on an outer side of the positioning protrusion, and an outer side edge of the clamping notch abuts against the positioning member.

6 Claims, 2 Drawing Sheets

TERMINAL CRIMP TOOL CAPABLE OF REPLACING JAWS BY RAPID INSERTION AND EXTRACTION

CROSS-REFERENCE TO RELATED APPLICATIONS

This application claims priority to Chinese Patent Application No. 202221951411.5 with a filing date of Jul. 25, 2022. The content of the aforementioned application, including any intervening amendments thereto, is incorporated herein by reference.

TECHNICAL FIELD

The present disclosure relates to the technical field of electrician tools, and in particular, to a terminal crimp tool capable of replacing jaws by rapid insertion and extraction.

BACKGROUND

A terminal crimp tool is used to crimp connectors or end caps of aluminum or copper wires in electric power engineering, and the heads are mainly used to tightly connect the connectors or end caps. Crimping terminals have different shapes according to types and thicknesses of wires, some are Y-shaped, O-shaped, and even some are only tubular bodies. Different wires and electrical appliances to be connected require different jaws. Most of terminal crimp tools on the market cannot replace the jaws. Although very few terminal crimp tools can replace the jaws, they generally have defects such as troublesome replacement and poor clamping of the jaws.

SUMMARY

In view of the defects in the prior art, the present disclosure provides a terminal crimp tool capable of replacing jaws by rapid insertion and extraction, such that the terminal crimp tool is convenient, easy and labor-saving to replace the jaws, and the jaws are firmly clamped.

The present disclosure provides a terminal crimp tool capable of replacing jaws by rapid insertion and extraction, including a crimp tool body, where a pair of openable heads are provided at a front end of the crimp tool body, and the two heads each are provided with a jaw;

two clamping plates are provided at a front part of each of the heads, a jaw mounting groove is formed between the two clamping plates, and a positioning member is provided in the jaw mounting groove;

the jaw is provided in the jaw mounting groove, positioning protrusions extending along a front-rear direction and respectively abutting against inner side edges of the two clamping plates are provided on two sides of the jaw, a clamping notch clamped outside the positioning member is provided on a rear part of the jaw on an outer side of the positioning protrusion, and an outer side edge of the clamping notch abuts against the positioning member; and a buckle is provided outside each of the heads, a first buckle portion is provided on the buckle, a second buckle portion is provided on an outer side edge of the jaw, and the buckle is capable of controlling combination or separation of the first buckle portion and the second buckle portion.

Furthermore, rotating shafts are coaxially arranged on two sides of the buckle, the buckle is rotatably mounted between the two clamping plates of the head through the rotating shaft, the first buckle portion is a clamping protrusion provided on an inner side, in front of the rotating shaft, of the buckle, the second buckle portion is a slot provided on the outer side of the jaw, and the head is provided with an elastic member for providing an elastic force for the jaw to keep the clamping protrusion clamped in the slot.

Furthermore, the clamping protrusion is designed as a right-triangle block structure, a rear side of the clamping protrusion is a right-angle edge abutting against a side wall of a rear side of the slot, and a front side of the clamping protrusion is an inclined edge.

Furthermore, the elastic member is a tension spring, a connecting arm extending toward the inner side is provided on the buckle behind the rotating shaft, a connecting pillar is provided between the two clamping plates of the head behind the jaw, one end of the tension spring is fixed to an inner end of the connecting arm, and other end of the tension spring is fixed to the connecting pillar.

Furthermore, a pressing portion is provided on an outer side of a rear part of the buckle.

Furthermore, the positioning member includes a wheel axle mounted between the two clamping plates of the head and a bearing mounted on the wheel axle, and the bearing abuts against the outer side edge of the clamping notch.

Furthermore, a guide portion is provided on a rear part of the outer side edge of the clamping notch, and an inner side of the guide portion is chamfered to form a guide surface.

The beneficial effects of the present disclosure are as follows:

The jaws are inserted into the jaw mounting grooves at the front part of the heads, the positioning protrusions on the two sides of the jaws abut against the inner side edges of the two clamping plates, and the outer side edges of the clamping notches on the jaws abut against the positioning members, to position the jaws in an inward-outward direction. After the jaws are inserted in place, the first buckle portions on the buckles are clamped into the second buckle portions on the jaws to lock the jaws in a front-rear direction, such that the jaws can be firmly mounted in the jaw mounting grooves. When the jaws need to be extracted for replacement, the first buckle portions on the buckles are separated from the second buckle portions on the jaws, such that the jaws can be easily extracted from the jaw mounting grooves. After the jaws are extracted, new jaws are aligned and inserted into the jaw mounting grooves, and the jaws are locked through the buckles to complete the replacement. Therefore, the present disclosure can implement rapid insertion and extraction of the jaws, and is convenient, easy and labor-saving to replace the jaws, and the jaws are firmly clamped.

BRIEF DESCRIPTION OF THE DRAWINGS

In order to illustrate the specific embodiments of the present disclosure or the technical solutions in the prior art more clearly, accompanying drawings needing to be used in the description of the specific embodiments or the prior art will be briefly described below. In all the accompanying drawings, similar elements or portions are generally identified by similar reference numerals. In the accompanying drawings, each element or portion is not necessarily drawn to the actual scale.

Figure 1:
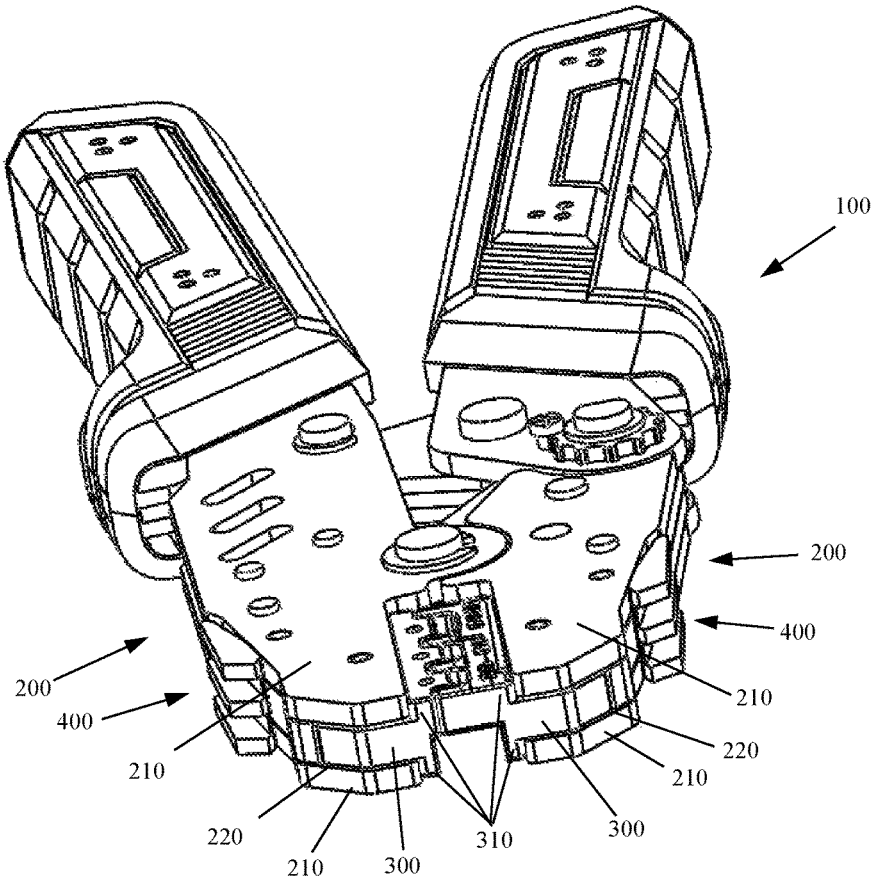
FIG. 1 is a schematic diagram of an overall structure according to an embodiment of the present disclosure.

Reference Numerals: 100—Crimp tool body; 200—Head; 210—Clamping plate; 220—Jaw mounting groove; 230—Positioning member; 231—Wheel axle; 232—Bearing; 240—Connecting pillar; 300—Jaw; 310—Positioning protrusion; 320—Clamping notch; 321—Guide portion; 330—Second buckle portion; 400—Buckle; 410—First buckle portion; 420—Rotating shaft; 430—Elastic member; 440—Pressing portion; and 450—Connecting arm.

DETAILED DESCRIPTION OF THE EMBODIMENTS

The embodiments of the technical solutions of the present disclosure will be described in detail below with reference to the accompanying drawings. The following embodiments are only used to more clearly illustrate the technical solutions of the present disclosure. Therefore, these embodiments are merely exemplary and are not intended to limit the protection scope of the present disclosure.

It should be noted that the technical terms or scientific terms used herein should have the ordinary meanings as understood by those skilled in the art to which the present disclosure belongs, unless otherwise stated.

Figure 2:
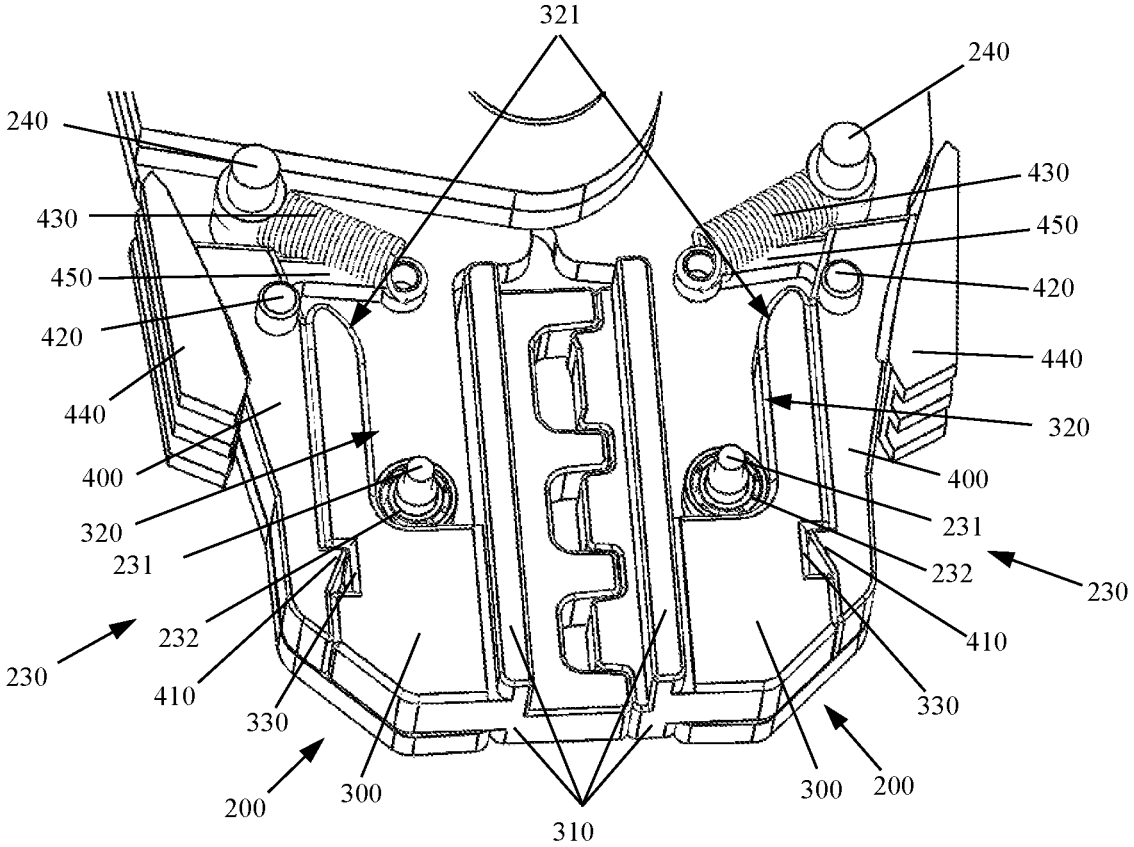
FIG. 2 is a schematic structural diagram when a clamping plate on one side of the head is hid according to an embodiment of the present disclosure.

As shown in FIG. 1 and FIG. 2, an embodiment of the present disclosure provides a terminal crimp tool capable of replacing jaws by rapid insertion and extraction, including a crimp tool body 100. A pair of openable heads 200 are provided at a front end of the crimp tool body 100, and the two heads 200 each are provided with a jaw 300.

Two clamping plates 210 are provided at a front part of each of the heads 200, a jaw mounting groove 220 is formed between the two clamping plates 210, and a positioning member 230 is provided in the jaw mounting groove 220.

The jaws 300 are mounted in the jaw mounting grooves 220, positioning protrusions 310 extending along a front-rear direction and respectively abutting against inner side edges of the two clamping plates 210 are provided on two sides of the jaw 300, a clamping notch 320 clamped outside the positioning member 230 is provided on a rear part of the jaw 300 on an outer side of the positioning protrusion 310, and an outer side edge of the clamping notch 320 abuts against the positioning member 230.

A buckle 400 is provided outside each of the heads 200, a first buckle portion 410 is provided on the buckle 400, a second buckle portion 330 is provided on an outer side edge of the jaw 300, and the buckle 400 is capable of controlling combination or separation of the first buckle portion 410 and the second buckle portion 330.

The jaws 300 are inserted into the jaw mounting grooves 220 at the front part of the heads 200, the positioning protrusions 310 on the two sides of the jaws 300 abut against the inner side edges of the two clamping plates 210, and the outer side edges of the clamping notches 320 on the jaws 300 abut against the positioning members 230, to position the jaws 300 in an inward-outward direction. After the jaws 300 are inserted in place, the first buckle portions 410 on the buckles 400 are clamped into the second buckle portions 330 on the jaws 300 to lock the jaws 300 in a front-rear direction, such that the jaws 300 can be firmly mounted in the jaw mounting grooves 220. When the jaws 300 need to be extracted for replacement, the first buckle portions 410 on the buckles 400 are separated from the second buckle portions 330 on the jaws 300, such that the jaws 300 can be easily extracted from the jaw mounting grooves 220. After the jaws 300 are extracted, new jaws 300 are aligned and inserted into the jaw mounting grooves 220, and the jaws 300 are locked through the buckles 400 to complete the replacement. Therefore, the present disclosure can implement rapid insertion and extraction of the jaws 300, and is convenient, easy and labor-saving to replace the jaws 300, and the jaws 300 are firmly clamped.

In one embodiment, rotating shafts 420 are coaxially arranged on two sides of the buckle 400, the buckle 400 is rotatably mounted between the two clamping plates 210 of the head 200 through the rotating shaft 420, the first buckle portion 410 is a clamping protrusion provided on an inner side, in front of the rotating shaft 420, of the buckle 400, the second buckle portion 330 is a slot provided on the outer side of the jaw 300, and the head 200 is provided with an elastic member 430 for providing an elastic force for the jaw 300 to keep the clamping protrusion clamped in the slot. When the jaw 300 is mounted in the jaw mounting groove 220, the clamping protrusion on the buckle 400 is clamped into the slot on the jaw 300 under the action of the elastic member 430, to lock the jaw 300 into the jaw mounting groove 220. When the jaw 300 needs to be extracted, only the rear part of the buckle 400 needs to be pressed, such that the clamping protrusion at the front part of the buckle 400 is turned up to exit the slot. Then, the jaw 300 can be easily extracted from the jaw mounting groove 220.

Preferably, the clamping protrusion is designed as a right-triangle block structure, a rear side of the clamping protrusion is a right-angle edge abutting against a side wall of a rear side of the slot, and a front side of the clamping protrusion is an inclined edge. In this way, when the jaws 300 are inserted, the jaws 300 can automatically jack up the clamping protrusions; and after the jaws 300 are inserted in place, the clamping protrusions on the buckles 400 are automatically clamped into the slots on the jaws 300 under the action of the elastic members 430. Therefore, there is no need to press the buckles 400 in the insertion process of the jaws 300.

Preferably, the elastic member 430 is a tension spring, a connecting arm 450 extending toward the inner side is provided on the buckle 400 behind the rotating shaft 420, a connecting pillar 240 is provided between the two clamping plates 210 of the head 200 behind the jaw 300, one end of the tension spring is fixed to an inner end of the connecting arm 450, and the other end of the tension spring is fixed to the connecting pillar 240. In this way, the tension springs can pull the buckles 400 to the outer side obliquely rearward, to provide an elastic force for the jaws 300 to keep the clamping protrusions clamped in the slots.

In addition to the structures of the tension springs, the elastic members 430 may also use such structures as torsion springs, which will not be described in detail herein.

To facilitate pressing the buckles 400, pressing portions 440 are provided on outer sides of rear part of the buckles 400.

In one embodiment, the positioning member 230 includes a wheel axle 231 mounted between the two clamping plates 210 of the head 200 and a bearing 232 mounted on the wheel axle 231, and the bearing 232 abuts against the outer side edge of the clamping notch 320. In the process of inserting and extracting the jaws 300, the positioning members 230 are in rolling connection to the outer side edges of the clamping notches 320 through the bearings 232, such that the smoothness and fluency of inserting and extracting the jaws 300 can be improved.

In one embodiment, a guide portion 321 is provided on a rear part of the outer side edge of the clamping notch 320, and an inner side of the guide portion 210 is chamfered to form a guide surface. When the jaws 300 are inserted, the positioning members 230 are guided into the clamping notches 320 through the guide surfaces, to facilitate alignment during re-insertion of the jaws 300.

Finally, it should be noted that the above embodiments are provided merely for describing the technical solutions of the present disclosure, but not for limiting the present disclosure. Although the present disclosure is described in detail with reference to the above embodiments, a person of ordinary skill in the art should understand that they may still make modifications to the technical solutions described in the above embodiments or make equivalent replacements to some or all technical features thereof; and these modifications or replacements do not make the essence of the corresponding technical solution depart from the scope of the technical solutions of the embodiments of the present disclosure, and shall fall within the scope of claims and specification of the present disclosure.

What is claimed is:

1. A terminal crimp tool capable of replacing jaws by rapid insertion and extraction, comprising a crimp tool body, wherein a pair of openable heads are provided at a front end of the crimp tool body, and the two heads each are provided with a jaw; two clamping plates are provided at a front part of each of the heads, a jaw mounting groove is formed between the two clamping plates, and a positioning member is provided in the jaw mounting groove; the jaw is mounted in the jaw mounting groove, positioning protrusions extending along a front-rear direction and respectively abutting against inner side edges of the two clamping plates are provided on two sides of the jaw, a clamping notch clamped outside the positioning member is provided on a rear part of the jaw on an outer side of the positioning protrusion, and an outer side edge of the clamping notch abuts against the positioning member; a buckle is provided outside each of the heads, a first buckle portion is provided on the buckle, a second buckle portion is provided on an outer side edge of the jaw, and the buckle is capable of controlling combination or separation of the first buckle portion and the second buckle portion; and wherein the positioning member comprises a wheel axle mounted between the two clamping plates of the head and a bearing mounted on the wheel axle, and the bearing abuts against the outer side edge of the clamping notch.

2. The terminal crimp tool according to claim 1, wherein rotating shafts are coaxially arranged on two sides of the buckle, the buckle is rotatably mounted between the two clamping plates of the head through the rotating shaft, the first buckle portion is a clamping protrusion provided on an inner side, in front of the rotating shaft, of the buckle, the second buckle portion is a slot provided on the outer side of the jaw, and the head is provided with an elastic member for providing an elastic force for the jaw to keep the clamping protrusion clamped in the slot.

3. The terminal crimp tool according to claim 2, wherein the clamping protrusion is designed as a right-triangle block structure, a rear side of the clamping protrusion is a right-angle edge abutting against a side wall of a rear side of the slot, and a front side of the clamping protrusion is an inclined edge.

4. The terminal crimp tool according to claim 2, wherein the elastic member is a tension spring, a connecting arm extending toward the inner side is provided on the buckle behind the rotating shaft, a connecting pillar is provided between the two clamping plates of the head behind the jaw, one end of the tension spring is fixed to an inner end of the connecting arm, and the other end of the tension spring is fixed to the connecting pillar.

5. The terminal crimp tool according to claim 2, wherein a pressing portion is provided on an outer side of a rear part of the buckle.

6. The terminal crimp tool according to claim 1, wherein a guide portion is provided on a rear part of the outer side edge of the clamping notch, and an inner side of the guide portion is chamfered to form a guide surface.

* * * * *